US006508654B1

(12) United States Patent
Tatz

(10) Patent No.: US 6,508,654 B1
(45) Date of Patent: Jan. 21, 2003

(54) MALE ELECTRICAL PLUG LOCKING DEVICE

(76) Inventor: Eliezer Tatz, 201-180 Dr., No. 209, North Miami Beach, FL (US) 33160

( * ) Notice: Subject to any disclaimer, the term of this patent is extended or adjusted under 35 U.S.C. 154(b) by 0 days.

(21) Appl. No.: 10/098,065

(22) Filed: Mar. 13, 2002

(51) Int. Cl.[7] ..... H01R 13/44
(52) U.S. Cl. ..... 439/134
(58) Field of Search ..... 439/134, 133

(56) References Cited

U.S. PATENT DOCUMENTS 2,664,734 A * 1/1954 McEneaney ..... 439/134
2,733,416 A * 1/1956 Evalt ..... 439/134
5,055,057 A * 10/1991 Boyer ..... 439/134
5,507,656 A * 4/1996 Ales ..... 439/133
5,666,829 A 4/1996 Aikens
6,056,563 A * 5/2000 Betzler ..... 439/134
6,142,797 A * 11/2000 Bailey ..... 439/134
6,159,025 A * 12/2000 Derman ..... 439/134

* cited by examiner

*Primary Examiner*—Gary Paumen
(74) *Attorney, Agent, or Firm*—Christopher & Weisberg, P.A.

(57) ABSTRACT

The invention is a compact locking device with minimal moving parts for securing an electrical power cord with male prongs having holes without damaging the prongs of the plug. The device comprises a rigid body, inside of which is a lock assembly, an elongated member cooperatively engaged to the lock assembly and an inwardly biased generally V-shaped spring with two outer arm members, each including a knob thereon. The knobs are positioned to cooperatively engage the holes in the prongs when the lock is engaged, such as the insertion of a key, and the elongated member spreads the outer arm members of the spring. The knobs are separated from the holes when the lock is disengaged, i.e. the key is rotated towards its initial position. The body is shaped so that a third ground prong on the plug would not interfere with the device.

5 Claims, 2 Drawing Sheets

MALE ELECTRICAL PLUG LOCKING DEVICE

BACKGROUND OF THE INVENTION

1. Field of the Invention

The field of the invention relates generally to locking devices and particularly to a locking device for electrical appliances and electrical power tools having a male electrical plug in order to prevent the unwanted use of said appliances or tools.

2. Description of Related Art

Common electrical appliances such as computers, televisions, toasters and microwave ovens often need protection from unauthorized use. Further, electrical power tools such as electric drills and saws can be hazardous if left unattended. Protection may often be best obtained through a locking device that is made operational by a key. This protection could be used to prevent children from using dangerous appliances, or handling unprotected electrical power tools or to prevent unauthorized use of the appliance in places such as electronics stores. While there are several possible solutions to the problem, a simple, easy-to-manufacture device is needed which has a minimal number of moving parts.

Other locking devices for electrical devices are known. U.S. Pat. No. 6,142,797 issued to Bailey teaches a device that uses oddly shaped functional components in its interior that would be difficult to manufacture and could easily break. Also, U.S. Pat. No. 6,159,025 issued to Derman teaches a lock. However, the Derman reference requires a sturdy cable through the body. In addition, U.S. Pat. No. 5,666,829 issued to Aikens teaches a plug lock. However, in the Aikens device, a bolt spreads the prongs of the plug. Over time, the spreading of the prongs of the electrical plug would cause significant damage to the device. Also, U.S. Pat. No. 5,507,656 issued to Ales requires several moving parts that may break, and an extra securing device such as a padlock. Ales requires two springs, a coil spring and a flat spring, thereby unnecessarily increasing the cost of production. Also, Ales, includes a bulky and unwieldy plunger to release the device from the lock.

The prior art inventions are flimsy, bulky, and expensive or require additional, unnecessary parts in their manufacture. Accordingly, what is needed is a lock for a male electrical plug that is simple and easy to manufacture. A need also exists for a lock with a minimum of moving parts. In addition, a lock is needed which will secure the electrical device and prevent its unwanted use while not damaging the plug or the device itself.

The instant invention has been directed to the effective resolution of the aforementioned shortcomings and to the meeting of the aforementioned needs.

BRIEF SUMMARY OF THE INVENTION

The present invention provides a novel and unique compact locking device for securing and locking an appliance's electrical power cord plug thereby preventing the unwanted use of the appliance.

The present invention is compact, lightweight and easy to manufacture. The present invention will secure an electrical appliance with a minimal number of moving parts. Also, the present invention is easier and less costly to manufacture than the prior art, and has none of the fragile pieces found in the prior art.

The present invention is a compact locking device for securing a male power cord plug having a plurality of prongs, the device comprising a body member having one or more plug-receiving apertures for receiving the prongs of the plug, each prong containing one or more holes, means for rotatably receiving a portion of a key, a rotatable member situated within the body member capable of rotating from a first disengaged position to a second engaged position, the rotatable member rotating in the same direction as the rotation of the key, and means for engaging the holes of the prongs upon rotation of the key thereby preventing the prongs from being withdrawn from the body member.

In a preferred embodiment, the locking device comprises a body member having one or more plug-receiving apertures for receiving the prongs, each prong containing one or more holes, a key-lock mechanism within the body, the key-lock mechanism including a channel for receiving a portion of a key, the key capable of being rotated within the channel, and a spring member secured within the body member, the spring member having two outer arm members, each outer arm member having a knob disposed upon its outer edge wherein the elongated member is positioned between the outer arm members. The key-lock mechanism further comprises an elongated member wherein the elongated member rotates from a first substantially parallel position with respect to the arm members, to a second substantially transverse position with respect to the arm members, the elongated member rotating in the same direction as the rotation of said key. Upon rotation of the key within the channel, the elongated member is rotated from the first to the second position thereby biasing the outer arm members outward. Upon the outward biasing of the arm members, the knobs of the spring member cooperatively engage the holes in the prongs of the plug thereby preventing the prongs from being withdrawn from the body member.

In an alternate embodiment of the invention, the plug-receiving apertures are located on the body member such that a ground fault disrupter prong on the plug would be located outside the device when the prongs are inserted within the apertures. In an alternate embodiment, the body member further comprises an opening to accommodate the ground fault disrupter prong in the plug.

The present invention is also a method for securing a male power cord plug with prongs having holes within a body member, comprising the steps of inserting the prongs of the plug within one end of the body member, inserting a key within another end of the body member, upon rotation of said key, outwardly biasing two outer arm members of a spring, the spring affixed within the body member, wherein each outer arm member has a knob thereon whereby upon rotation of the key within the body member, the knobs of the spring cooperatively engage the holes in the prongs of the plug thereby preventing the prongs from being withdrawn from the body member.

In a further embodiment of the present invention, a compact locking device is provided for securing a male power cord plug with prongs having holes. The locking device comprises a rigid plastic body with an interior and an exterior, a top, a bottom, a front, a back, a left and a right side, wherein each side has an inner and outer surface. The body includes two apertures on the back side of the body, each aperture for accommodating one of the prongs, a key-activated lock assembly accessible on the front side of the body for locking and unlocking the plug, an elongated member cooperatively attached to the lock-activated assembly, the elongated member rotatable to a transverse position in relation to the plug when the lock assembly is engaged, and an inwardly biased generally V-shaped spring with a base and two outer arm members, each outer arm member having an outside section and a circular knob thereon. The base of the spring is attached to the inner surface of the body, and the knobs are in cooperative connection with the holes in the prongs when the lock-activated assembly is engaged. The knobs are released from the holes in the prongs when the lock-activated assembly is disengaged. The apertures are located so that a ground fault disrupter on the plug would be located outside the device when the prongs are within the apertures.

It is an object of the invention to provide an easy-to-manufacture locking device for a male electrical plug in order to prevent the unauthorized use of electrical appliance and/or electrical power tools.

It is also an object of this invention to provide a locking device with a minimal number of moving parts.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE SEVERAL VIEWS OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 3:
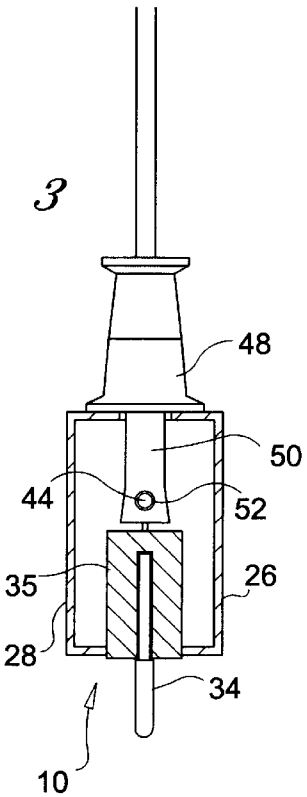
FIG. 3 is a cut-away side view of the preferred embodiment of the invention in the locked position.

The present invention is a compact locking device for securing an electrical power cord male plug as shown in FIGS. 1 through 7 and described generally at 10.

As shown in FIGS. 1–7, the device has a rigid body 12 with interior surfaces 14 and exterior surfaces 16, top side 26, bottom side 28 (not shown) front side 18, back side 20, left side 24 and right side 22, wherein each side has an inner and outer surface. Body 12 can be made of any suitable sturdy material such as plastic, metal or the like. Body 12 preferably has two vertical slits 30 situated on the back side 20 for accommodating prongs 50 of a male electrical plug 48. It is preferred that body 12 be made of hard plastic or metal to keep plug 48 secure therein.

Body 12 also has an aperture 32 on the exterior surface 16 of body 12. Aperture 32 represents the open end of channel 33. Channel 33 is sized to receive a standard key 34 and is designed for locking and unlocking plug 48. It is preferred that aperture 32 be positioned is on front side 18 of body 12, and that the locking capability of device 10 is activated by the insertion and rotation of key 34. However, other locations for the aperture, such as top side 26 or bottom side 28 may be preferred for certain applications. In addition, other locking activation means are also known in the art, such as a magnetic lock or a touchpad with code.

Figure 2:
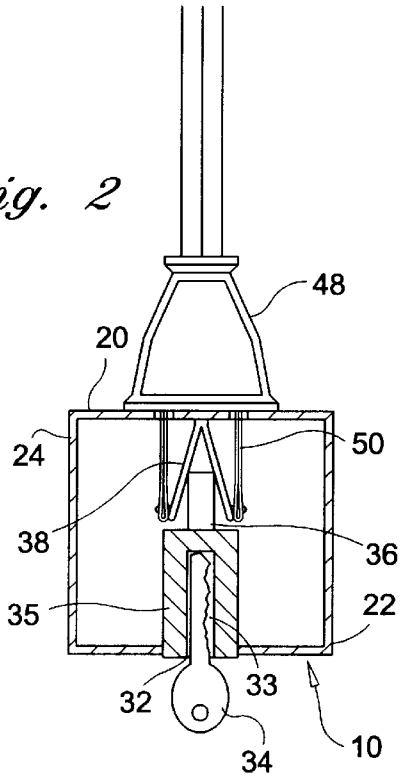
FIG. 2 is a cut-away top view of the preferred embodiment of the invention in the locked position.
Figure 1:
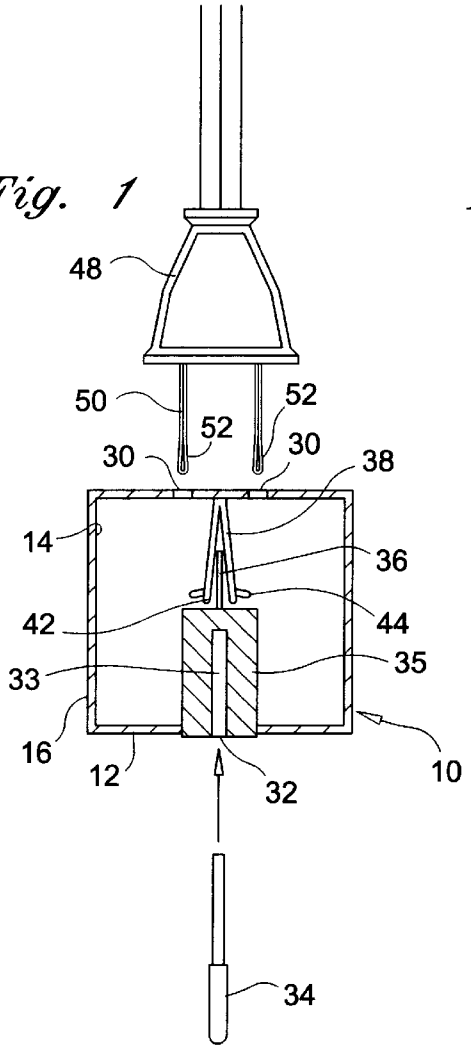
FIG. 1 is a cut-away top view of the preferred embodiment of the invention.

An elongated member 36 is contained within body 12 and is in contact with locking assembly 35. Elongated member 36 is cooperatively engaged to assembly 35, as shown in FIG. 1. Preferably, member 36 is made from metal, plastic or other sturdy material. As shown in FIGS. 1 and 2, member 36 presents a narrow profile in relation to prongs 50 prior to the insertion of key 34, i.e. when the device is in activate. Referring to FIG. 2, upon the insertion and rotation of key 34 within channel 33, assembly 35 rotates along with key 34. Assembly 35 is a key-lock assembly common in the art and typically used in locking devices where a key is needed to rotate the locking mechanism. Elongated member 36 is likewise rotated to a wider, transverse position in relation to plug 48, so that member 36 presents a wider profile between prongs 50.

Figure 4:
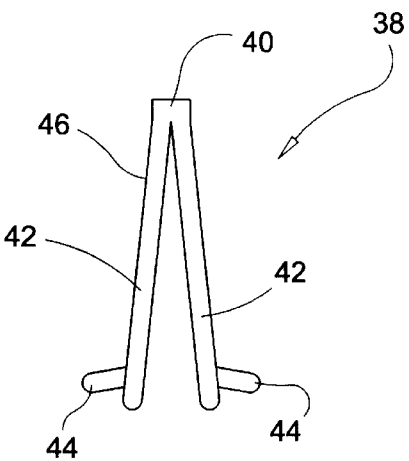
FIG. 4 is a side view of the spring mechanism of the invention.

Located on the interior 14 of body 12 is an inwardly biased generally V-shaped spring 38. Spring 38 may be made of metal, plastic or any other resilient material. Spring 38, preferably comprised of tempered steel, is illustrated in FIG. 4. Spring 38 preferably has a base 40 and two outer arm members 42, each having one end joined at base 40. Base 40 is affixed to the interior 14 of back side 20 of body 12 between slits 30. Outer arm members 42 enclose elongated member 36, as depicted in FIG. 1 and FIG. 2. A knob 44 is located on the outer surface 46 near the end of each outer member 42 of spring 38. As shown in FIG. 4, it is preferred that knobs 44 are a distance from the very tip of the outer members 42. However, knobs 44 alternatively may be located on the very tips of the outer members 42. Spring 38 is located within body 12, and in cooperative contact with elongated member 36.

When plug 48 of an electrical appliance or an electrical power tool is inserted into device 10 and it is desired to secure and lock the plug therein in order to prevent the use of the device, key 34 is inserted into aperture 32 and the device is engaged. Upon the rotation of the key into channel 33, assembly 35 rotates, and elongated member 36 is also rotated in the same direction as the rotation of key 34 due to its cooperative engagement with assembly 35, and a wider profile of member 36 is presented with respect to prongs 50. Upon rotation, member 36 spreads apart outer arm members 42 of spring 38, as shown in FIG. 2. As outer arm members 42 spread apart, knobs 44 engage the holes 52 in prongs 50 of plug 48, thereby firmly securing the prongs 50 of plug 48 within device 10.

In an alternate embodiment, when key 34 is inserted and rotated, outer arm members 42 of spring 38 are again forced laterally outward by member 36, but instead of holes 52 of prongs 50 receiving knobs 44 to secure the plug within body 12, outer arm members 42 are forced outward and "trap" each prong 50 against the inner wall of body 12. In this fashion, prongs 50 are pressed against the interior walls of body 12 by the outward lateral movement of each arm member 42 due to the rotation of key 34 within body 12 and the rotation of member 36. The result is the same, i.e. prongs 50 of plug 48 are trapped within body 12 as long as the key remains in a locked position. This embodiment is particularly useful in instances where there are no holes in the prongs of the plug.

As shown in FIGS. 1 and 2, spring 38 is attached to the interior side 14 of back side 20 of body 12, so long as knobs 44 on spring 38 engage holes 52 when elongated member 36 presents its wider profile in relation to prongs 50. However, spring 38 may alternatively be attached to interior side 14 of front side 18 of body 12. Alternatively, spring 38 may be also formed as an intrinsic part of the interior 14 of device 10 to simplify the manufacturing process.

Knobs 44 are in cooperative engagement with holes 52 in prongs 50 when the key is inserted in aperture 32 and rotated within chamber 33. The inwardly biased tension in spring 38 releases knobs 44 from their cooperative engagement with holes 52 when the key is rotated back to its initial (insertion) position. For ease of manufacturing, knobs 44 are an intrinsic part of spring 38. However, knobs 44 may alternatively be attached to spring 38 in a separate manufacturing process. As shown in FIG. 4, knobs 44 are preferably rounded to facilitate engagement. However, other shapes that would allow for engagement with holes 52, such as cones or cylinders, are also contemplated.

Figure 6:
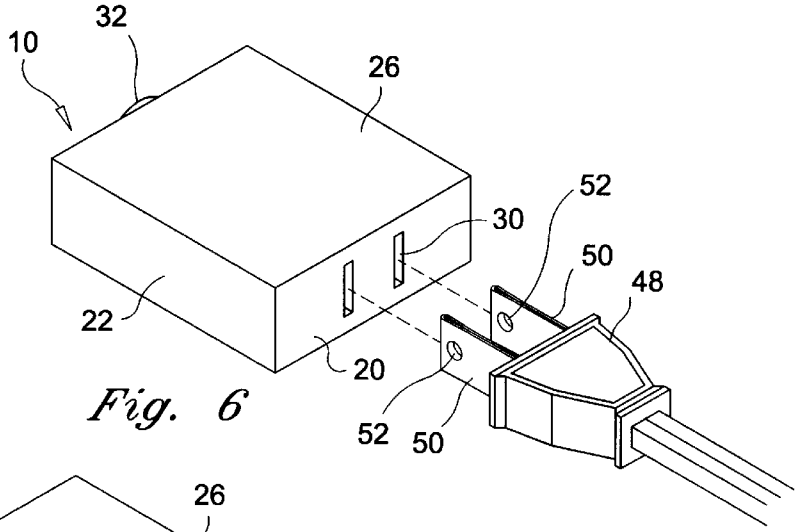
FIG. 6 is a perspective view of the preferred embodiment showing the vertical slits into which an electrical plug may be inserted.
Figure 7:
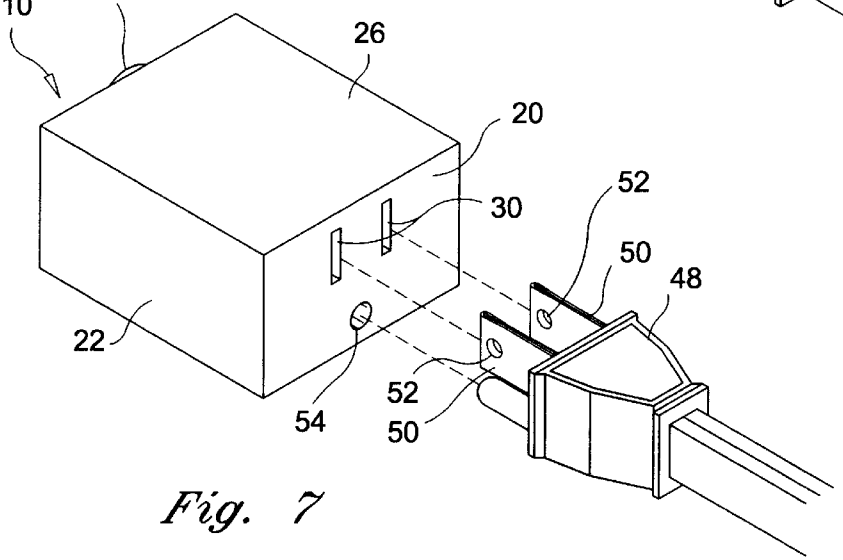
FIG. 7 is a perspective view of an alternative embodiment of the invention.
Figure 5:
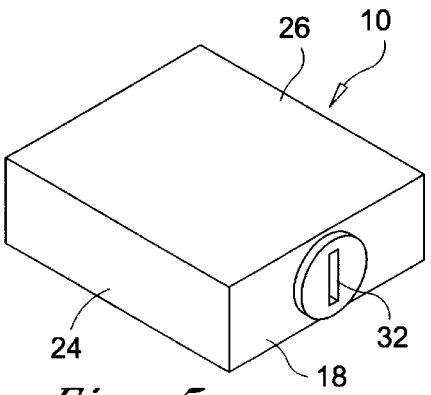
FIG. 5 is a perspective view of the preferred embodiment showing the locking mechanism of the invention.

In the preferred embodiment, as shown in FIGS. 5 and 6, slits 30 are located so that a ground fault disrupter located below prongs 50 on plug 48 would be located outside the device 10 when the prongs 50 are inside the slits 30. In an alternative embodiment, shown in FIG. 7, back side 20 of body 12 further includes an opening 54 for a ground fault disrupter prong in plug 48.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. A compact locking device for securing a male power cord plug having a plurality of prongs, said device comprising:

a body member having one or more plug-receiving apertures for receiving said prongs, each said prong containing one or more holes;

a key-lock mechanism rotatably secured within said body, said key-lock mechanism including a channel for receiving a key, said key capable of being rotated within said channel;

a spring member secured within said body member, said spring member having two outer arm members, each outer arm member having a knob disposed upon an outer edge thereof; and said key-lock mechanism further comprising an elongated member positioned between said outer arm members wherein said elongated member rotates from a first substantially parallel position with respect to said arm members to a second substantially transverse position with respect to said arm members, said elongated member rotating in the same direction as the rotation of said key;

whereby upon rotation of said key within said channel, said elongated member is rotated from said first position to said second position thereby biasing said outer arm members outwardly, forcing the knobs of said spring member to cooperatively engage the holes in the prongs of said plug thereby preventing said prongs from being withdrawn from said body member.

2. The device of claim 1, wherein said plug-receiving apertures are located on the body member so that a ground fault disrupter on the plug would be located outside the device when the prongs are inserted within said apertures.

3. The device of claim 1, wherein the body member further comprises an opening to accommodate a ground fault disruptor prong in the plug.

4. A method for securing a male power cord plug with prongs having holes within a body member, comprising the steps of:

inserting said prongs of said plug within one end of said body member;

inserting a key within another end of said body member;

upon rotation of said key, outwardly biasing two outer arm members of a spring, said spring affixed within said body member, each arm outer member having a knob thereon whereby upon rotation of said key within said body member, the knobs of said spring cooperatively engage the holes in the prongs of said plug thereby preventing said prongs from being withdrawn from said body member.

5. A compact locking device for securing a male power cord plug with prongs having holes, comprising:

a rigid plastic body having an interior and an exterior surface;

said body including a plurality of apertures on a back side of the body, each aperture for accommodating one of said prongs;

a key-activated lock assembly accessible on an opposing side of said body for locking and unlocking the plug;

an elongated member cooperatively attached to the lock-activated assembly, said elongated member rotatable to a transverse position in relation to the plug when the lock assembly is engaged; and an inwardly biased generally V-shaped spring with a base and two outer arm members, each said outer arm member having an outside section and a circular knob thereon;

wherein the base of the spring is attached to the inner surface of the body;

wherein the knobs are in cooperative connection with the holes in the prongs when the lock-activated assembly is engaged, and the knobs are released from the holes in the prongs when the lock-activated assembly is disengaged;

wherein the apertures are located so that a ground fault disrupter on the plug would be located outside the device when the prongs are within the apertures.

* * * * *